United States Patent [19]

Davison et al.

[11] Patent Number: 4,821,629

[45] Date of Patent: Apr. 18, 1989

[54] DYNAMICALLY BALANCED EXHAUST PIPE CAP

[76] Inventors: Jerom G. Davison, 3361 Stoneybrook, Oklahoma City, Okla. 73120; Gerald E. Hollingshead, 7609 Northwest 34th St., Bethany, Okla. 73008

[21] Appl. No.: 190,248

[22] Filed: May 4, 1988

[51] Int. Cl.[4] ..... F23L 17/02

[52] U.S. Cl. ..... 98/59

[58] Field of Search ..... 98/59, 71, 73, 74, 77, 98/119, 122

[56] References Cited

U.S. PATENT DOCUMENTS

| | | | |
|---|---|---|---|
| 2,494,016 | 1/1950 | Taylor | 98/59 |
| 2,508,615 | 5/1950 | Lukes | 98/59 |
| 2,983,216 | 5/1961 | Stade et al. | 98/59 |
| 3,363,537 | 1/1968 | De Penning | 98/59 |
| 3,523,499 | 8/1970 | Bauerschmidt | 98/59 |
| 3,788,072 | 1/1974 | Burger | 98/59 |
| 4,495,859 | 7/1985 | Janke et al. | 98/59 |
| 4,667,582 | 5/1987 | Davison et al. | 98/59 |
| 4,727,796 | 3/1988 | Derkach | 98/59 |
| 4,742,766 | 5/1988 | Davison et al. | 98/59 |

FOREIGN PATENT DOCUMENTS

| | | | |
|---|---|---|---|
| 57-135217 | 8/1982 | Japan | 98/59 |
| 648119 | 12/1950 | United Kingdom | 98/59 |

*Primary Examiner*—Harold Joyce

*Attorney, Agent, or Firm*—Laney, Dougherty, Hessin & Beavers

[57] ABSTRACT

A dynamically balanced exhaust pipe cap which includes an elongated tubular member having an upper end defined by an upper edge lying in a plane extending an an acute angle to the longitudinal axis of the tubular member. A closure flap assembly is pivotally secured to the upper end of the tubular member and includes a closure plate having a pair of balancing plates which extend downwardly from the closure plate on opposite sides of the tubular member. A pair of wind vanes are secured to the two balancing plates.

6 Claims, 2 Drawing Sheets

DYNAMICALLY BALANCED EXHAUST PIPE CAP

RELATED APPLICATIONS

This application is a continuation-in-part of U.S. patent application Ser. No. 019,632, filed Feb. 24, 1987, entitled "DYNAMICALLY BALANCED EXHAUST PIPE CAP", now U.S. Pat. No. 4,742,766 issued on May 10, 1988, which is a continuation-in-part of U.S. patent application Ser. No. 862,131 filed on May 12, 1986, and entitled "DYNAMICALLY BALANCED EXHAUST PIPE CAP", now U.S. Pat. No. 4,667,582 issued on May 26, 1987.

BACKGROUND OF THE INVENTION

1. Field of the Invention

This invention relates to pivotally mounted caps of the type used for closing the atmospheric opening of an exhaust pipe at a time when exhaust gas is not being vented therethrough, and more particularly, to a dynamically balanced closure cap for an exhaust pipe, which cap is geometrically so configured, and has its mass so distributed, that it functions effectively and resists counteractive wind and gravity forces.

2. Brief Description of the Prior Art

Efforts to provide better dynamic balancing in caps for diesel engine exhaust pipes have taken various forms. Thus, in Stade et al U.S. Pat. No. 2,983,216, a rain cap for an engine exhaust pipe is provided, and this cap is of the gravity actuated-type in which the cover member is adapted to fit over the open end of the stack or exhaust pipe, and carries a counterbalancing section or portion which is pivotally supported in a way, and at a location, such that the cap tends, by reason of the shift of the center of gravity, to reseat or close when the exhaust gases are not acting on the cap to open it.

This cap is susceptible, however, to opening under wind pressure, or the pressure of air developed as the tractor upon which the cap is mounted is carried over the road on a transport vehicle if the cap is faced in an improper direction. In the full closed position, the cap extends horizontally across the upper end of the exhaust pipe, and it is therefore necessary for the cap to open through almost 90° in order for it to achieve a fully open position. This requires the exertion of a greater opening force from the exhaust gases which are being vented through the exhaust pipe, and can result in an undesirably high level of back pressure being exerted on the exhaust gases attempting to pass through the exhaust pipe. Also, in this situation where the cap extends horizontally across the squared off upper end of an exhaust pipe of this type, the cap has further to fall to its closure position under the influence of gravity when the gas pressure is relieved. This results in a very undesirable loud banging noise as the cap seats in its closed position against the top of the exhaust pipe.

Bauerschmidt U.S. Pat. No. 3,523,499 discloses a weather cap construction for an exhaust pipe. The weather cap is held on the exhaust pipe by a collar which is closed about the exhaust pipe by a suitable clamping bolt. This construction has the advantage of allowing the collar to be varied some in size so that it can be fitted tightly about exhaust pipes of different sizes. In the Bauerschmidt cap, the pivoted closure element is supported for pivotation about a pivotal axis which is displaced laterally from the vertical axis of the exhaust pipe by a substantial distance, and when the cap is in its elevated, fully opened position, it exerts essentially no back pressure on the gases passing from the exhaust pipe. It must, however, open through an angle which is almost 90°, and therefore in the initial phase of the opening arc, an undesirable amount of back pressure may be exerted on the exhaust gases. A positive stop is provided to limit how far the crank upon which the closed cap is carried will open in its full open position, and this positive stop is in a position such that the center of gravity still remains inside the pivotal axis. The crank arm will therefore fall rapidly, under the influence of gravity, to a closed position, once the exhaust gases cease to be vented through the exhaust pipe.

In De Penning U.S. Pat. No. 3,363,537, a tractor exhaust pipe cover is illustrated and described. The cover depicted includes a cap which pivots into, and away from, a horizontal plane representing the position of closure of the cap. The cap carries reflector devices in the form of a pair of platelike reflectors mounted on the opposite side of the pivotal axis of the cap structure from the cap plate proper. These reflectors afford some weight which assists the cap in opening in response to the force exerted by the upwardly moving exhaust gases.

Other types of exhaust cap structures are those which are depicted and described in Taylor U.S. Pat. No. 2,494,016; Burger U.S. Pat. No. 3,788,072 and Lukes U.S. Pat. No. 2,508,615.

BRIEF DESCRIPTION OF THE PRESENT INVENTION

The present invention is an improved, dynamically balanced protective cap which is used on the exhaust pipes of diesel engines, or other internal combustion engines, for the purpose of preventing dust, debris and rain from entering the exhaust pipe, and thereby fouling the engine or preventing smooth running of the engine. The protective cap also is constructed so that the engine is protected from wind force acting deleteriously upon any turbocharger which may be a part of the engine, and be accesible to the down draft of wind entering the exhaust pipe and proceeding downwardly toward the engine.

The protective cap of the invention includes an annular clamping band by which the cap assembly in its entirety is secured to an exhaust pipe which projects in a vertical direction from an internal combustion engine for the purpose of venting engine exhaust gases to the atmosphere. A closure flap assembly is pivotally secured to the annular clamping band for pivotation about a horizontal axis in undergoing opening and closing movement with respect to the exhaust pipe upon which the protective cap is mounted.

A closure plate, which forms a part of the closure flap assembly, has a pair of parallel balancing plates secured to opposite sides of the closure plate and located on opposite sides of the tubular element. These balancing plates preferably lie in spaced parallel planes. The parallel balancing plates function to aid in distributing the weight, and in translating the center of gravity, of the movable closure cap assembly in such a way that the closure flap can be easily opened and easily closed when the exhaust gases terminate their flow through the exhaust pipe. Each of the parallel balancing plates carries a sleeve which receives a stub axle, or other pivotal element, which is connected to the clamping band by a mounting strap or plate. A pair of horizontally spaced, monoplanar wind vanes are secured to aligned edges of the two balancing plates, and each preferably extends normal to the respective balancing plate, with the two wind vanes preferably located in coplanar alignment with each other.

A damping element preferably positioned between the closure flap assembly and the clamping band damps the pivotal movement of the closure flap assembly so that the closure plate opens and closes more slowly and thus reduces the closing impact and noise level. The closure flap assembly also carries a slit plate which stops the opening movement of the closure plate by contact with a part of the closure plate structure. Upon making such contact, the slit plate makes only a slightly perceptible sound.

The dynamically balanced protective cap of the invention as thus constructed, obviates chattering caused by rapidly opening and closing in a cylical motion at a time when the engine is running, and exhaust gases are being vented through an exhaust pipe carrying the cap.

Another object of the invention is to provide a dynamically balanced, protective gas vent cap for mounting on the upper end of the exhaust pipe of a diesel engine, which cap opens and closes with lesser noise than prior art caps used for this purpose.

Another important object of the invention which is achieved by the structure utilized is the obviation of opening of the pivoted closure flap assembly under the force developed by an artificial or natural air movement developed either when the engine upon which the protective cap is mounted is standing stationary, or is being towed by means of an over-the-road vehicle.

An additional object of the invention is to provide a dynamically balanced exhaust cap for mounting on an exhaust pipe of an internal combustion engine, which exhaust cap requires little movement to move from its full closure position to a fully opened position, and thus requires relatively little exhaust gas pressure in order to achieve this opening, thereby reducing the propensity of such caps to cause an undesirable back pressure acting downwardly through the exhaust pipe to the location of the exhaust ports of the engine.

Another object of the invention is to vent hot exhaust gases past the closure flap assembly in a way which avoids deleterious carbon cake build up around the upper edge of the exhaust pipe.

A further object of the invention is to provide a dynamically balanced protective cap for the exhaust pipe of a diesel engine, which cap is characterized in having relatively few moving parts, and in having a relatively long and trouble free operating life.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

FIG. 6 is a perspective view of a split angle plate forming a part of the exhaust pipe cap of the invention.

DETAILED DESCRIPTION OF A PREFERRED EMBODIMENT OF THE INVENTION

Figure 1:
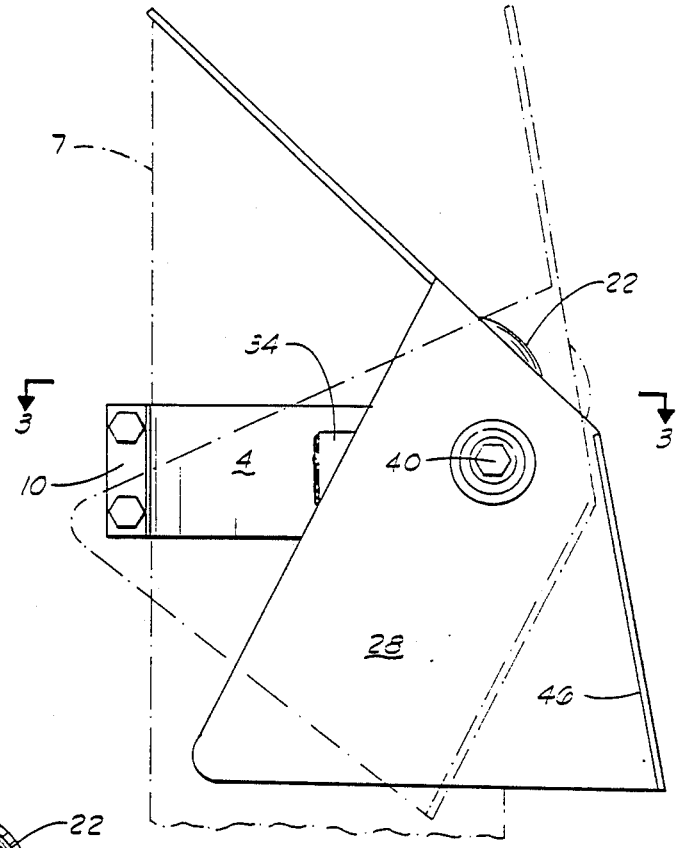
FIG. 1 is a side elevation view of the dynamically balanced exhaust pipe cap of the invention. The open position of the exhaust pipe cap is illustrated by the use of a dashed line, as is the position of an exhaust pipe upon which the cap is mounted.

The dynamically balanced exhaust pipe cap of the invention includes an annular clamping band 4, which, in the illustrated embodiment, is cylindrical in configuration and is split along one side. The clamping band 4 is diametrically sized so that it can be slipped over the top of an exhaust pipe 7 (shown in dashed lines). The exhaust pipe 7 can typically be any of those types of tubular elements used to vent exhaust gases from a diesel engine. The clamping band 4 has a forward side 6 and a rear side 8 and is split at its forward side. A pair of opposed, parallel flanges 10 and 12 which carry mating apertures permit bolts or screws 11 extended through these apertures to be used to tighten or constrict the band about the exhaust pipe 7.

In most types of exhaust pipes, the pipe is cut through at its upper end generally along a plane which extends at an acute angle to the longitudinal axis of the exhaust pipe, and thus terminates in an angulated bias cut which defines an oval-shaped opening at the upper end of the exhaust pipe. This type of exhaust pipe is typified by the exhaust pipe 7 illustrated in the drawings. Occasionally the exhaust pipe will be cut straight across in a plane normal to its longitudinal axis, however, in which case the principles of the present invention can still be utilized and are of advantage.

At its side opposite the flanges 10 and 12, the clamping band 4 carries a reverse bent or U-shaped hook 14 which has the lower end of an outer leg secured to the upper edge of the clamping band 4, and a short inner leg projecting down inside the exhaust pipe. The hook 14 functions to limit downward movement of the band 4 on the exhaust pipe 7. It will be noted also from FIG. 2 that the hook 14 is positioned in alignment with a carbon-relief indentation 22 in a closure plate 20 as hereinafter described.

Figure 2:
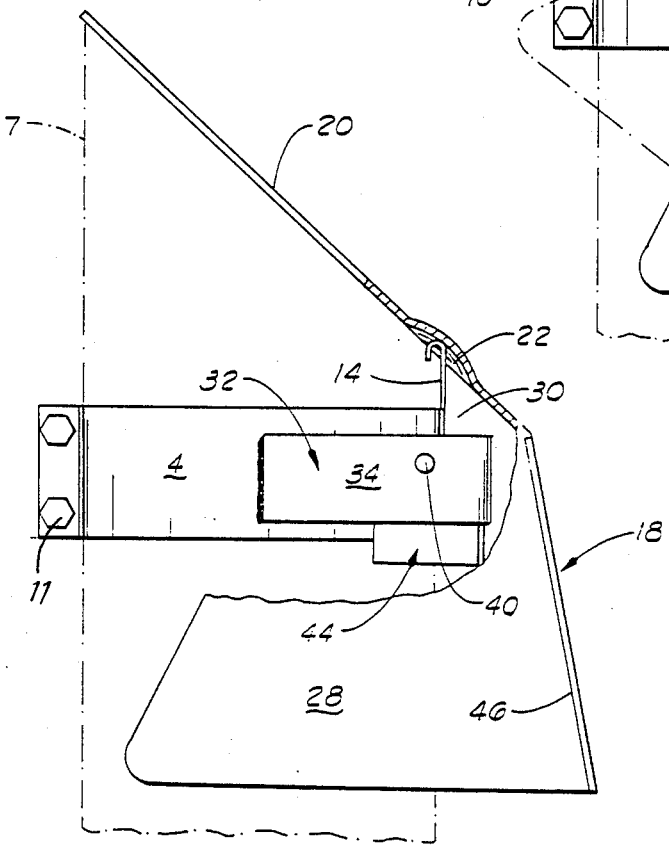
FIG. 2 is a view in side elevation similar to FIG. 1, but having part of the structure broken away to illustrate certain interior details.
Figure 3:
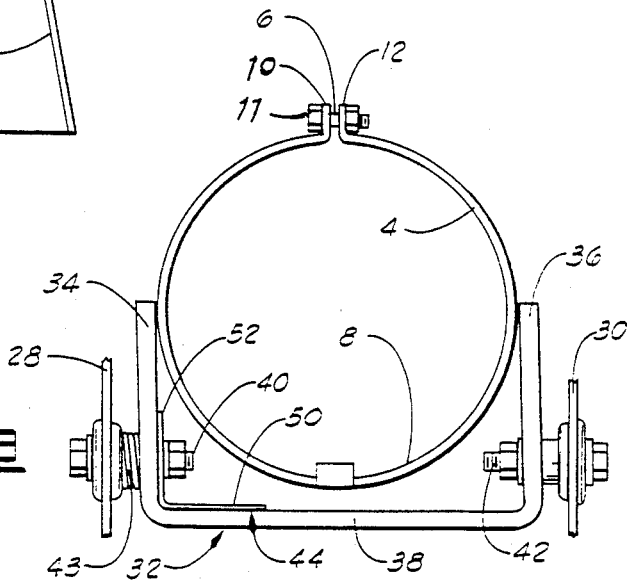
FIG. 3 is a sectional view taken along line 3—3 of FIG. 1.
Figure 4:
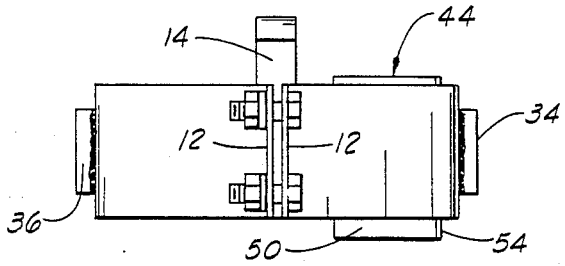
FIG. 4 is a front elevation view of an annular clamping band 4 forming a part of the exhaust pipe cap of the invention.
Figure 5:
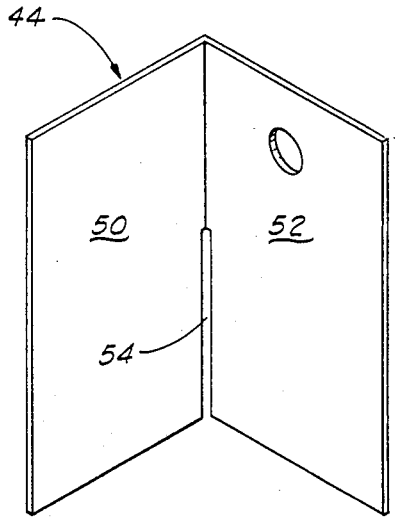
FIG. 5 is a rear elevation view of a closure flap assembly forming a part of the exhaust pipe cap of the invention.
Figure 3:
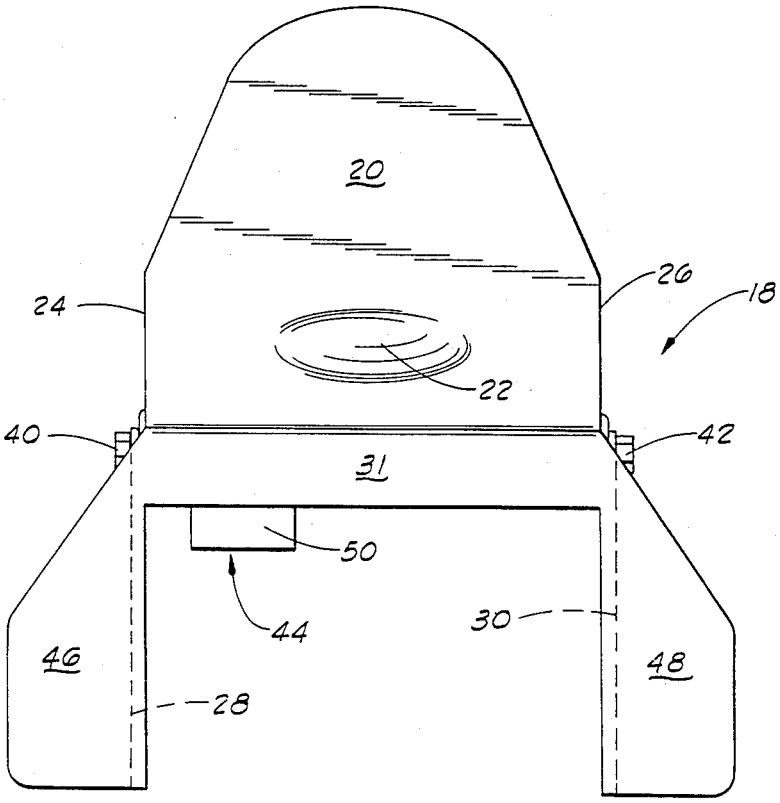

The dynamically balanced protective cap of the invention further includes a closure flap assembly designated generally by reference numeral 18. The closure flap assembly 18 includes a closure plate 20 which is most clearly illustrated in FIGS. 2 and 5. In the embodiment of the invention shown in FIGS. 1–5, the closure plate defines a carbon-relief indentation 22, as best illustrated in FIGS. 2 and 5. The closure plate 20 also is characterized in having a pair of opposed, lateral, parallel, side edges 24 and 26 disposed at the opposite sides of the rear portion of the cover plate as shown in FIG. 4.

A pair of downwardly extending, trapezoidally-shaped balancing plates 28 and 30 are secured along their upper edges to the respective lateral edges 24 and 26 of the closure plate 20. The balancing plates 28 and 30 are identically shaped and extend in spaced, parallel planes, and are disposed on opposite sides of the annular clamping band 4. A transverse plate 31 extends downwardly from the rear edge of the closure plate 20 between the lateral flanges balancing plates 28 and 30 as best illustrated in FIG. 5.

In order to pivotally mount the closure flap assembly 18 on the annular clamping band 4, a U-shaped mounting and arresting bracket 32 is secured to the outer periphery of the annular clamping band 4 as shown in FIG. 2. The arresting bracket 32 includes a pair of parallel legs 34 and 36 joined to the opposite ends of a web portion 38 which projects across the clamping band 4 at the rear side thereof. The legs 34 and 36 are welded, or otherwise suitably secured, to the opposite sides of the annular clamping band 4 as shown in FIG. 3.

A pair of threaded stub axles 40 and 42 function as pivotal axles used for mounting the closure flap assembly 18 upon the arresting bracket 32. The pivotal stub axles 40 and 42 extend through the respective legs 34 and 36 of the bracket 32, and through the downwardly extending, trapezoidally-shaped balancing plates 28 and 30.

A damping spring 43 is disposed around at least one of the stub axles 40 or 42, as shown in FIG. 2. In the case of some larger sizes of exhaust pipe caps, it may be desirable to use damping springs 43 around both of the stub axles 40 and 42. The damping spring 43 is compressed between the adjacent leg 34 or 36 of the arresting bracket 32 and the adjacent one of the balancing plates 28 or 30, and functions to retard the speed at which the closure flap assembly 18 undergoes pivotation in its opening and closing movements. This will, in turn, reduce or dampen the noise level of the opening and closing impacts of the closure plate 20.

In order to limit the distance that the closure flap assembly 18 can pivot in moving into an open position, a movement-limiting split angle plate 44 is secured to the U-shaped arresting bracket 32 in the right angle corner where the leg 34 intersects and joins the web or bight portion 38. The position of the split angle plate 44 is most clearly illustrated in FIGS. 2, 3 and 5 of the drawings. The split angle plate 44 includes a pair of rectangular plates 50 and 52 joined to each other at a right angle, and separated by a slot 54 extending partially along the line of intersection and joinder.

The closure flap assembly 18 further includes a pair of spaced, co-planar wind vanes 46 and 48 which are secured to the respective aligned rear edges of the two balancing plates 28 and 30, as shown in FIGS. 2 and 5. The wind vanes project 46 and 48 in a direction away from the tubular element 4.

OPERATION OF THE INVENTION

In utilizing the exhaust pipe cap of the invention, the annular clamping band is slipped over the top of the exhaust pipe 7 and is moved downwardly on the exhaust pipe until the U-shaped hook 14 engages the rear side of the exhaust pipe. This will be the action which occurs, whether the exhaust pipe be one which is cut on a bias at an angle of about forty-five degrees, or is one which is cut straight across. When the U-shaped hook 14 engages the upper side of the exhaust pipe as shown in FIG. 2, the clamping band 4 then extends around the exhaust pipe and is tightened on the exhaust pipe by means of bolts 11 which are extended through mating apertures in the parallel flanges 10 and 12 carried on opposite sides of the split at the forward side of the clamping band.

In this position, the closure plate 20 of the closure flap assembly 18 will close down across the top of the exhaust pipe, and when this occurs, the carbon-relief indentation 22 will accommodate the top of the U-shaped hook 14 so as to allow the plate to close against the upper edge of the exhaust pipe. The indentation 22 allows the gases to vent to the atmosphere sufficiently that no carbon build up around the edges of the exhaust pipe will occur, but rather the carbon particles will pass out through the atmospheric vent formed by the indentation.

In the operation of the exhaust cap, the closure plate 20 of the closure flap assembly 18 opens and closes under the influence of gravity and exhausted gases as has previously been explained in my prior U.S. Pat. Nos. 4,667,582 and 4,742,766, the teachings of which are incorporated herein by reference. The wind vanes also function as described in those patents.

In the present invention, however, the action of the exhaust cap is improved by the inclusion therein of the damping spring 43. The damping spring 43 exerts a frictional drag on the closure flap assembly 18 because the opposite ends of this damping spring are forced, due to the compression of the spring, against the adjacent leg 34 or 36 of the clamping bracket and the adjacent balancing plate 28 or 30. The slowing of the opening and closing movement of the closure plate 20 prevents this plate from banging loudly against the upper edge of the exhaust pipe as it closes.

The relatively quiet action of the exhaust cap of the present invention is also enhanced by the inclusion in the assembly of the split angle plate 44. At the time that the exhaust cap reaches its fully opened position, the split angle plate 44 acts as a stop by its contact with the stop plate 31 so as to limit any further opening movement of the closure plate 20. At this time, this contact of the split angle plate 44 with the stop plate 31 occurs with a relatively low level of noise or banging since the split in the angle-shaped plate has been found to damp out the noise and to result more in a "clicking" sound than in a "clanging" sound.

Although a preferred embodiment of the invention has been herein described in order to afford an understanding of the principles which underlie the invention, it will be understood that various changes and innovations can be made in the described and depicted preferred embodiment without departure from the basic principles of the invention. Changes of this type are therefore deemed to be circumscribed by the spirit and scope of the invention, except as the same may be necessarily limited by the appended claims or reasonable equivalents thereof.

What is claimed is:

1. A protective closure cap for an exhaust pipe comprising:

an annular clamping band for extending around, and mounting the cap upon, an exhaust pipe;

hook means connected to the clamping band and projecting therefrom for hooking over the upper edge of an exhaust pipe around which the clamping band extends; and a closure flap assembly pivotally connected to said annular clamping band for pivotation about a horizontal axis, said closure flap assembly comprising:

a closure plate of a size to fit across, and close by covering, the upper end of said exhaust pipe, said closure plate defining a carbon-relief indentation at a location aligned with said hook and adapted to bridge across the upper edge of said exhaust pipe when said clamping band is placed therearound and said hook is engaged with said upper edge of the exhaust pipe whereby exhaust gas from the exhaust pipe can bleed through said carbon-relief indentation sufficiently to avoid carbon build up on the upper edge of said exhaust pipe;

a pair of balancing plates connected to opposite sides of the closure plate and projecting downwardly on opposite sides of said clamping band;

a metallic stop element extending between said balancing plates;

axle means pivotally supporting the balancing plate on the clamping band for pivotation about a horizontal axis;

damping means dynamically and yieldingly cooperating with said closure flap assembly, and yieldingly resisting the pivotal movement of said balancing plates and closure plate about said horizontal axis to slow the opening and closing movement of said closure plate, and reduce the noise level of contact of the closure plate with the upper edge of the exhaust pipe upon closing; and means arresting the upward pivoting movement of said closure plate.

2. The protective closure cap as defined in claim 1 wherein said means arresting the upward pivoting movement of said closure plate includes a sound damping device for contacting said metallic stop element to arrest said upward pivoting movement while reducing the sound of such metallic contact.

3. A protective closure cap as defined in claim 1 and further characterized as including:

a U-shaped arresting bracket having a pair of opposed legs secured to opposite sides of said annular clamping band and having a bight portion interconnecting the legs and extending substantially parallel to a diameter of said clamping band; and wherein said axle means includes a pair of axles disposed on opposite sides of said annular clamping band and extending between a leg of said U-shaped arresting bracket and one of said balancing plates for pivotally supporting the balancing plates on said arresting bracket.

4. A protective closure cap as defined in claim 1 wherein said clamping means comprises a coil spring extending around said axle means in concentric relation to the pivotal axis of said closure flap assembly on said annular clamping band, said helical spring having one end bearing against one of said balancing plates and resiliently urged thereagainst by the compression of said spring.

5. A protective closure cap as defined in claim 1 wherein said hook means comprises a U-shaped, reverse bent portion having a pair of parallel legs interconnected by a bight portion, with one of said legs being positioned and adapted for dispostion inside said exhaust pipe when said annular clamping band is mounted therearound, and the other of said legs being disposed for disposition on the outside of said exhaust pipe with said interconnecting bight portion extending across the edge surrounding the opening at the other end of said exhaust pipe.

6. A protective closure cap as defined in claim 1 and further characterized as including a pair of wind vane plates, one of said wind vane plates extending substantially normal to, and being secured to, one of said balancing plates, with said wind vane plates being in substantially coplanar alignment with each other on opposite sides of said closure flap assembly.

* * * * *